US010442212B2

(12) United States Patent
Belval et al.

(10) Patent No.: US 10,442,212 B2
(45) Date of Patent: Oct. 15, 2019

(54) ROTARY DIGITAL PRINTING SYSTEM

(71) Applicant: Pad Print Machinery of Vermont, Inc., East Dorset, VT (US)

(72) Inventors: Mark J. Belval, Swanzey, NH (US); Ben M. Lessard, North Ferrisburgh, VT (US)

(73) Assignee: Pad Print Machinery of Vermont, Inc., East Dorset, VT (US)

( * ) Notice: Subject to any disclaimer, the term of this patent is extended or adjusted under 35 U.S.C. 154(b) by 0 days.

(21) Appl. No.: 15/960,663

(22) Filed: Apr. 24, 2018

(65) Prior Publication Data

US 2018/0304650 A1 Oct. 25, 2018

Related U.S. Application Data

(60) Provisional application No. 62/489,255, filed on Apr. 24, 2017.

(51) Int. Cl.
*B41J 3/407* (2006.01)
*B41M 1/40* (2006.01)

(52) U.S. Cl.
CPC ..... *B41J 3/4073* (2013.01); *B41M 1/40* (2013.01)

(58) Field of Classification Search
CPC ..... B41M 1/40; B41J 3/4073
See application file for complete search history.

(56) References Cited

U.S. PATENT DOCUMENTS 8,994,959 B2 3/2015 Beckhaus
9,193,146 B2 11/2015 Till
2013/0176358 A1 7/2013 Yamada et al.
(Continued)

FOREIGN PATENT DOCUMENTS

DE 102012223759 A1 6/2014
DE 102015216026 A1 2/2017
(Continued)

OTHER PUBLICATIONS

Search Report in International Application No. PCT/IB2018/052851 dated Jul. 9, 2018, 5 pages.
(Continued)

*Primary Examiner* — Julian D Huffman
(74) *Attorney, Agent, or Firm* — Marshall, Gerstein & Borun LLP

(57) ABSTRACT

A rotary digital printing system is disclosed, which includes: a print zone, including several independent print stations, each station including a respective print head, curing system, and read head; a number of fixtures, each fixture being configured to support an item that is to receive printed information, and including an encoder ring that can be read by a given print station's read head to determine a circumferential position and rotational speed of the fixture in question; a rotational drive for rotating each fixture positioned in a print station such that the surface of the item support member and an item disposed thereon is rotated past the print head and curing system for printing and curing; a conveyance module for transporting the fixtures to said print stations. The system is configured so as to convey, using the conveyance module, the plurality of fixtures through the print zone, stopping at one or more of the print stations.

14 Claims, 10 Drawing Sheets

(56) References Cited

U.S. PATENT DOCUMENTS

| | | | | |
|---|---|---|---|---|
| 2016/0159087 | A1 | 6/2016 | Sonnauer | |
| 2019/0070866 | A1* | 3/2019 | Kimura | B41J 3/4073 |
| 2019/0248128 | A1* | 8/2019 | Sharp | B41J 11/002 |

FOREIGN PATENT DOCUMENTS

| | | | |
|---|---|---|---|
| GB | 2230739 | A | 10/1990 |
| JP | 2010143200 | A | 7/2010 |
| WO | WO-2004/009360 | A1 | 1/2004 |
| WO | WO-2005/025873 | A2 | 3/2005 |
| WO | WO-2010/108527 | A1 | 9/2010 |
| WO | WO-2012/093077 | A1 | 7/2012 |
| WO | WO-2014/076704 | A1 | 5/2014 |
| WO | WO-2015/177599 | A1 | 11/2015 |
| WO | WO-2018/083163 | A1 | 5/2018 |
| WO | WO-2018/083164 | A1 | 5/2018 |
| WO | WO-2018/083167 | A1 | 5/2018 |

OTHER PUBLICATIONS

Combined Search and Examination Report in GB Application No. 1806648.0 dated Oct. 25, 2018, 6 pages.

* cited by examiner

ROTARY DIGITAL PRINTING SYSTEM

TECHNICAL FIELD

The present disclosure generally relates to the field of printing. In particular, the present disclosure is directed to a rotary digital printing system.

BACKGROUND ART

Current rotary digital printing solutions on the market today have either (1) low throughput, low cost, low fixture setup time, or (2) high throughput, high cost, high fixture setup time. The market does not currently have a medium cost, high throughput, low fixture setup time solution. The challenge forcing these two market options is that you must transport your complex fixture back to the starting position of the first print head while maintaining precision motion monitoring and control through the entire print zone. Currently, a way to achieve higher throughput is to maintain a singular rotary transport mechanism which can add substantial expense. One example of a machine that offers lower fixture set up time is a single piece rotary print. Both prior art approaches utilize a single print encoder to manage color-to-color registration between print stations. Rotary printing with multiple print stations requires high precision, for example, a circumferential tolerance of approximately +/−0.0013" for a 360 DPI inkjet head to avoid visual defects. Current approaches achieve the required tolerance by constantly tracking the circumferential speed and position of all fixtures through a single drive and a single encoder.

SUMMARY OF INVENTION

In one aspect, the present disclosure provides a rotary digital printing system, which comprises: a print zone, comprising a plurality of independent print stations, each station comprising a respective print head, and read head; a plurality of fixtures, each fixture being configured to support an item that is to receive printed information, and comprising an encoder ring that can be read by a given print station's read head to determine a circumferential position and rotational speed of the fixture in question; a rotational drive for rotating each fixture positioned in a print station such that the surface of the item support member and an item disposed thereon is rotated past the print head for printing; a conveyance module for transporting the fixtures to said print stations. The system is configured so as to convey, using the conveyance module, the plurality of fixtures through the print zone, stopping at one or more of the print stations.

BRIEF DESCRIPTION OF THE DRAWINGS

For the purpose of illustrating the disclosure, the drawings show aspects of one or more embodiments of the disclosure. However, it should be understood that the present disclosure is not limited to the precise arrangements and instrumentalities shown in the drawings, wherein.

DETAILED DESCRIPTION

Figure 1:
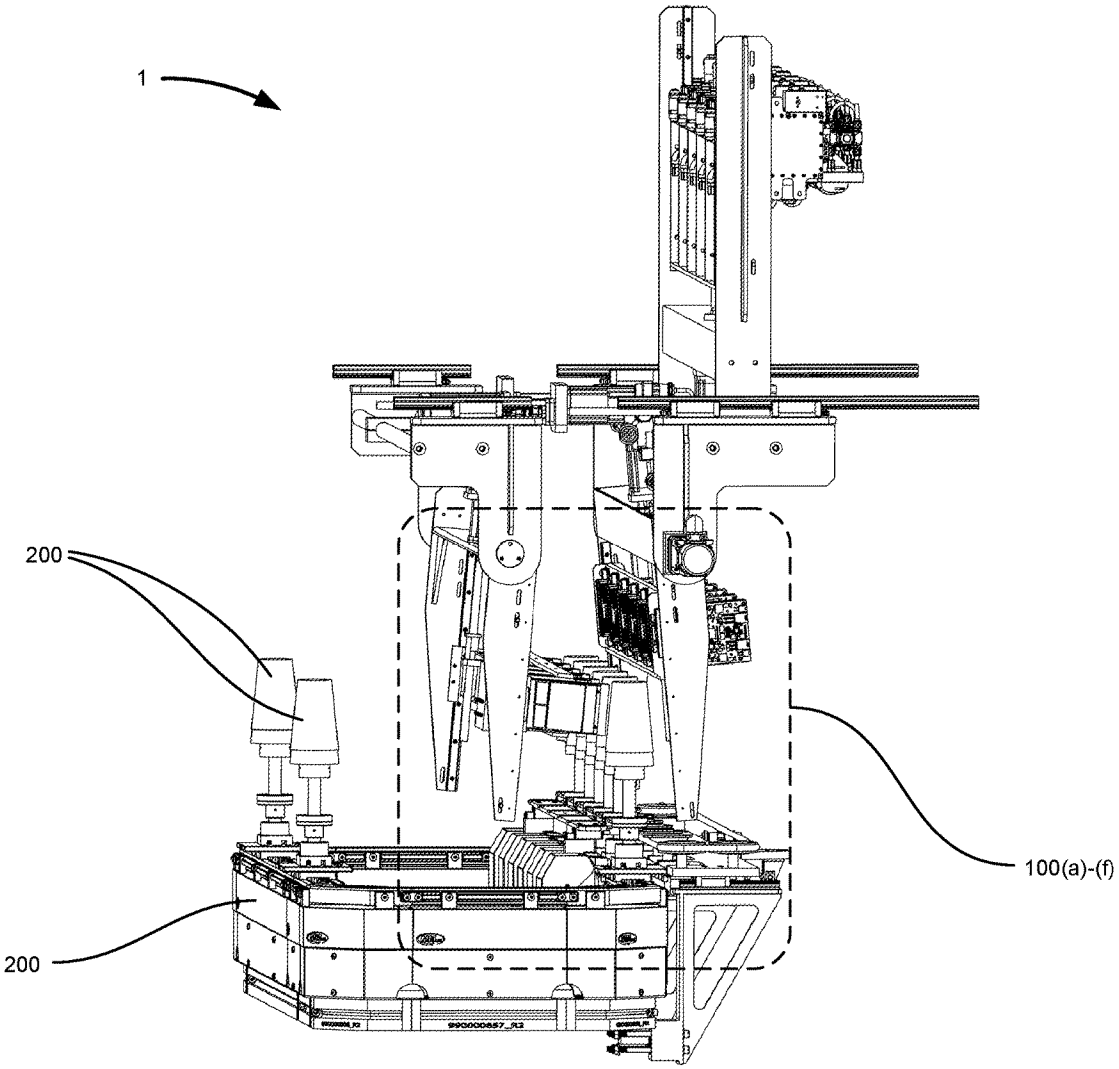
FIG. 1 is a perspective view of an example embodiment of a rotary digital printing system.
Figure 2:
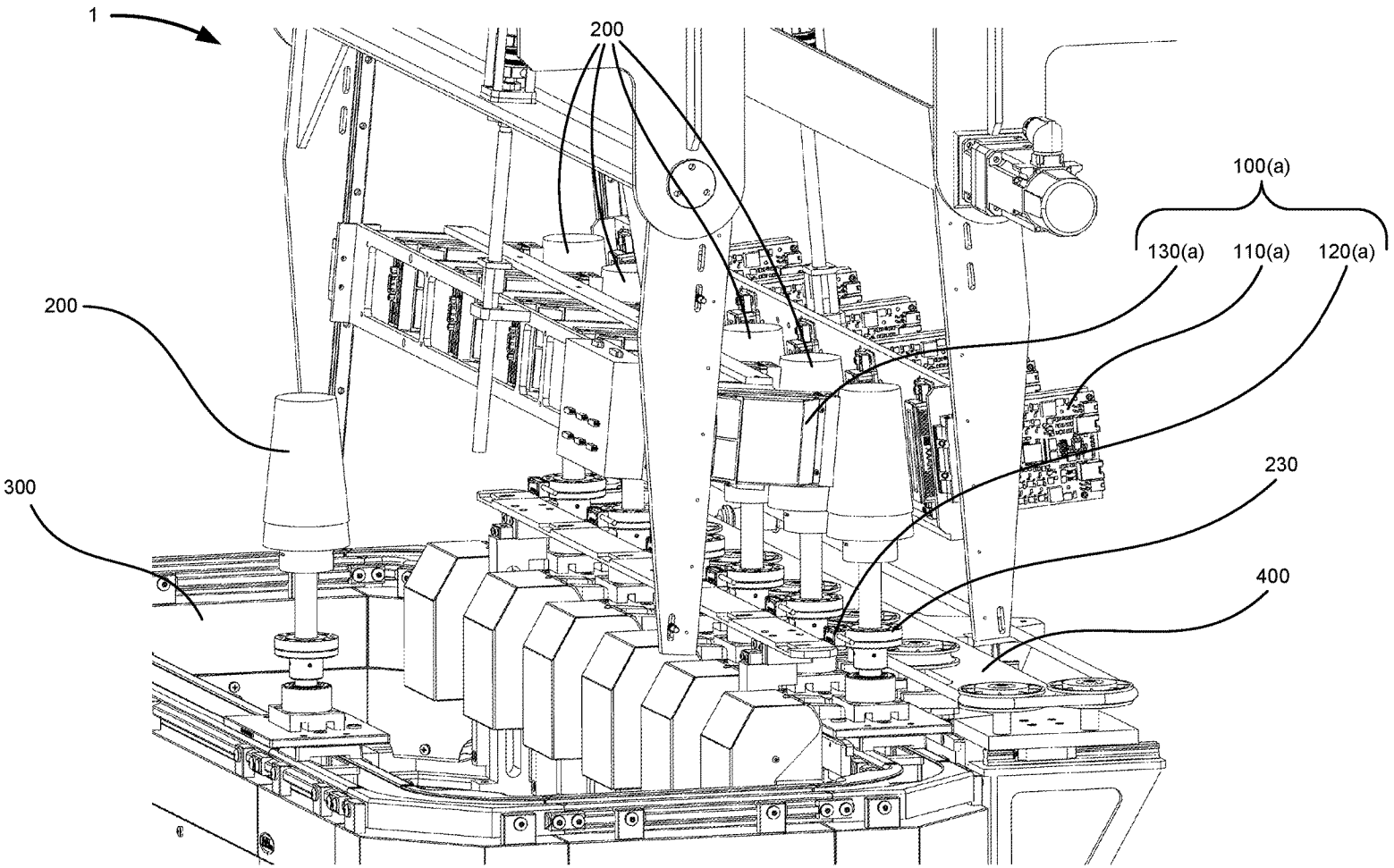
FIG. 2 is a perspective detail view of the printing system of FIG. 1.
Figure 3:
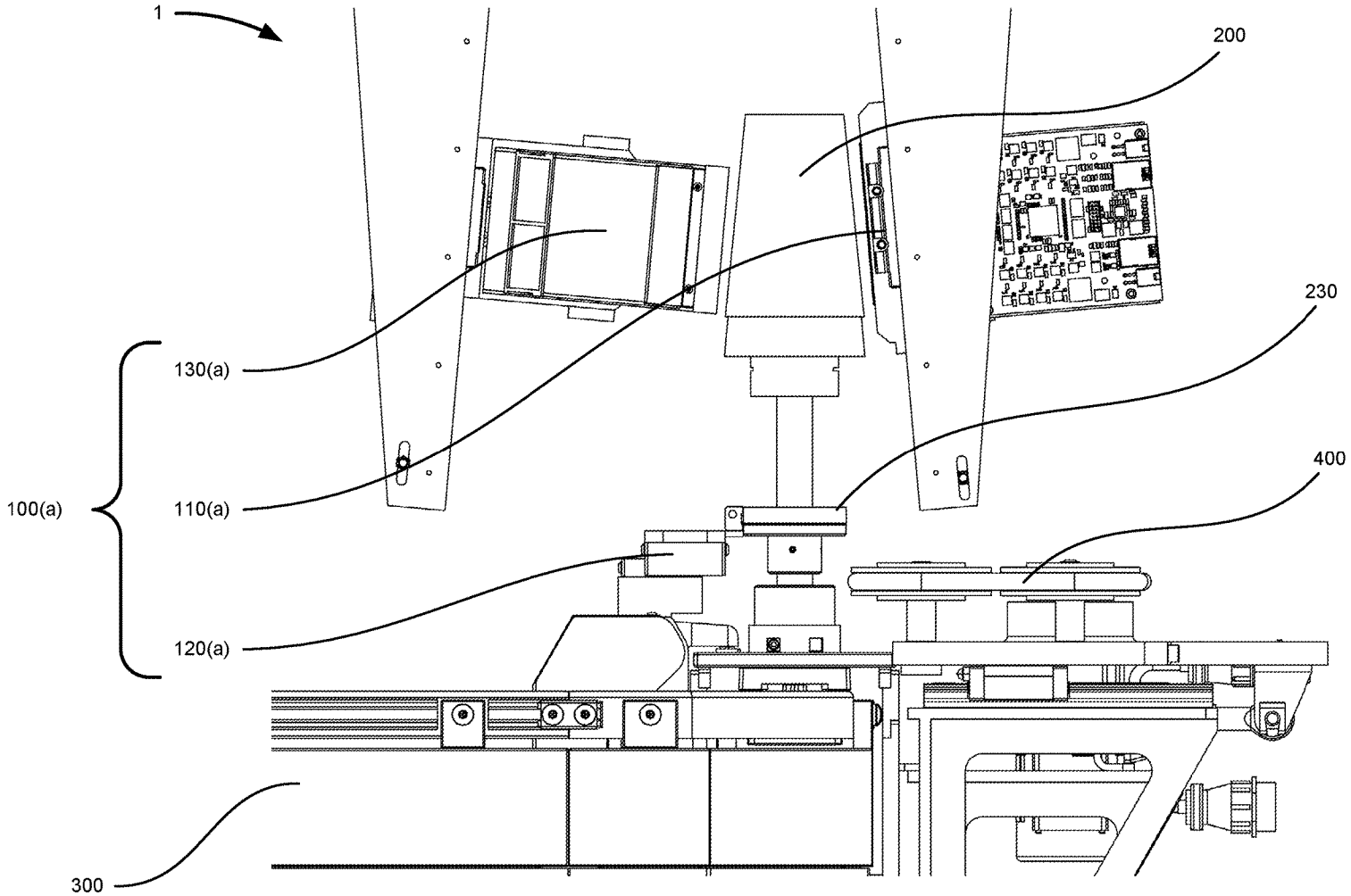
FIG. 3 is a plan detail view of the print zone of the printing system of FIGS. 1 and 2.

FIGS. 1-5 illustrate an example embodiment of a rotary digital printing system 1 with independent and intermittent fixture monitoring. Referring first to FIG. 1, which is a perspective view of the printing system 1, the example printing system 1 includes a print zone that includes six independent print stations 100 (*a*)-(*f*). As may be seen from FIGS. 2 and 3, which are respectively detail perspective and detail plan views of the printing system 1, each print station 100 (*a*)-(*f*) includes a print head 110, and a read head 120. For example, FIGS. 2 and 3 indicate the print head 110(*a*) and read head 120(*a*) of print station 100(*a*). A plurality of fixtures 200 can be conveyed through the print zone by a conveyance module 300, stopping at one or more of the print stations 100 (*a*)-(*f*). As shown in FIGS. 2 and 3, each fixture 200 includes an encoder ring 230 that can be read by a given print station's read head 120 for determining, e.g., a circumferential position and rotational speed of a fixture 200. As is also shown in FIGS. 2 and 3, the system further includes a rotational drive 400, configured for rotating fixtures 200 positioned in a number of print stations 100 (*a*)-(*f*); indeed, in some embodiments, such as that shown in FIGS. 1-5, the rotational drive 400 may be configured for rotating every fixture 200 that is positioned at a print station 100 (*a*)-(*f*)).

Figure 4:
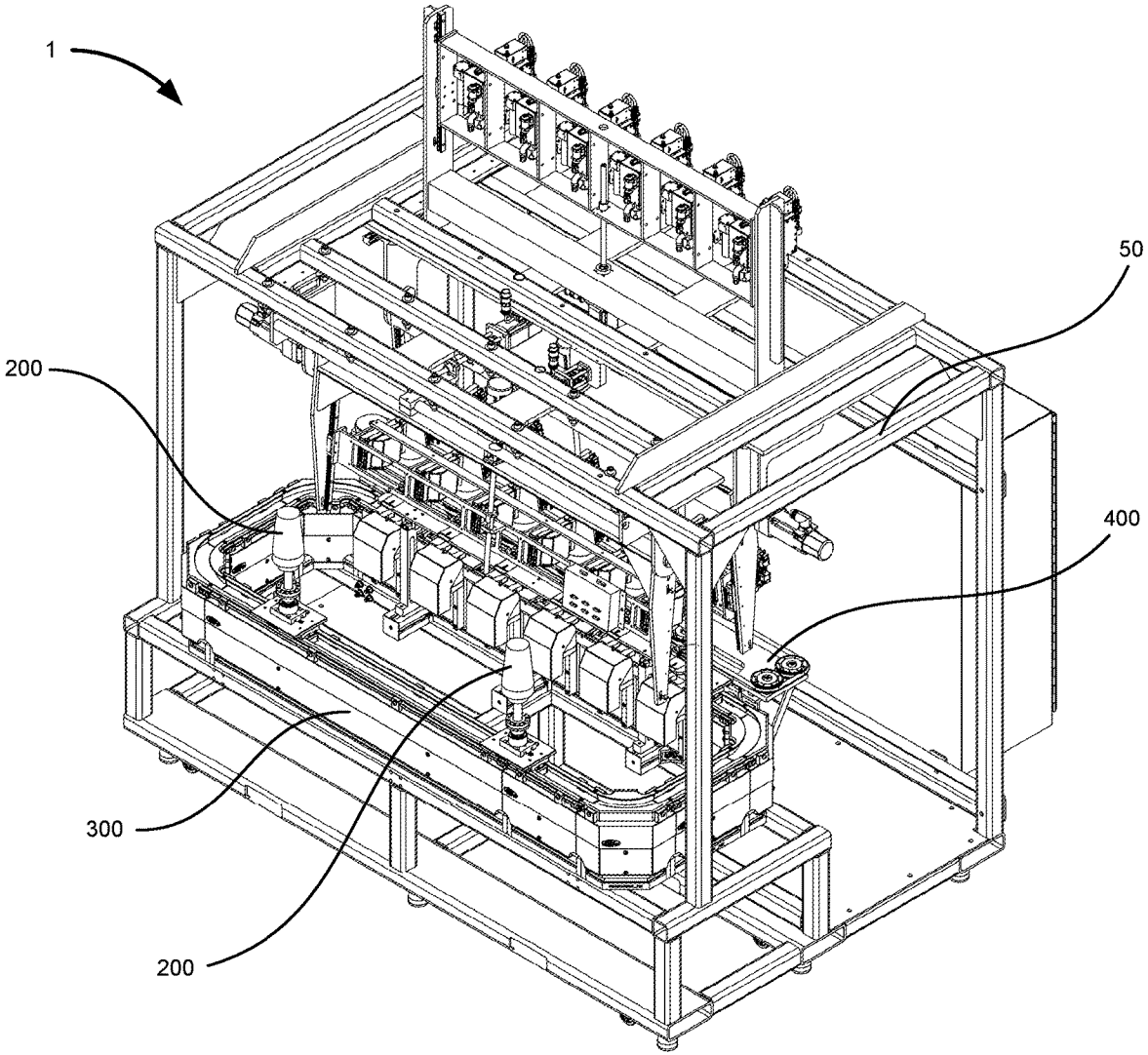
FIG. 4 is a further perspective view of the printing system of FIGS. 1-3.
Figure 5:
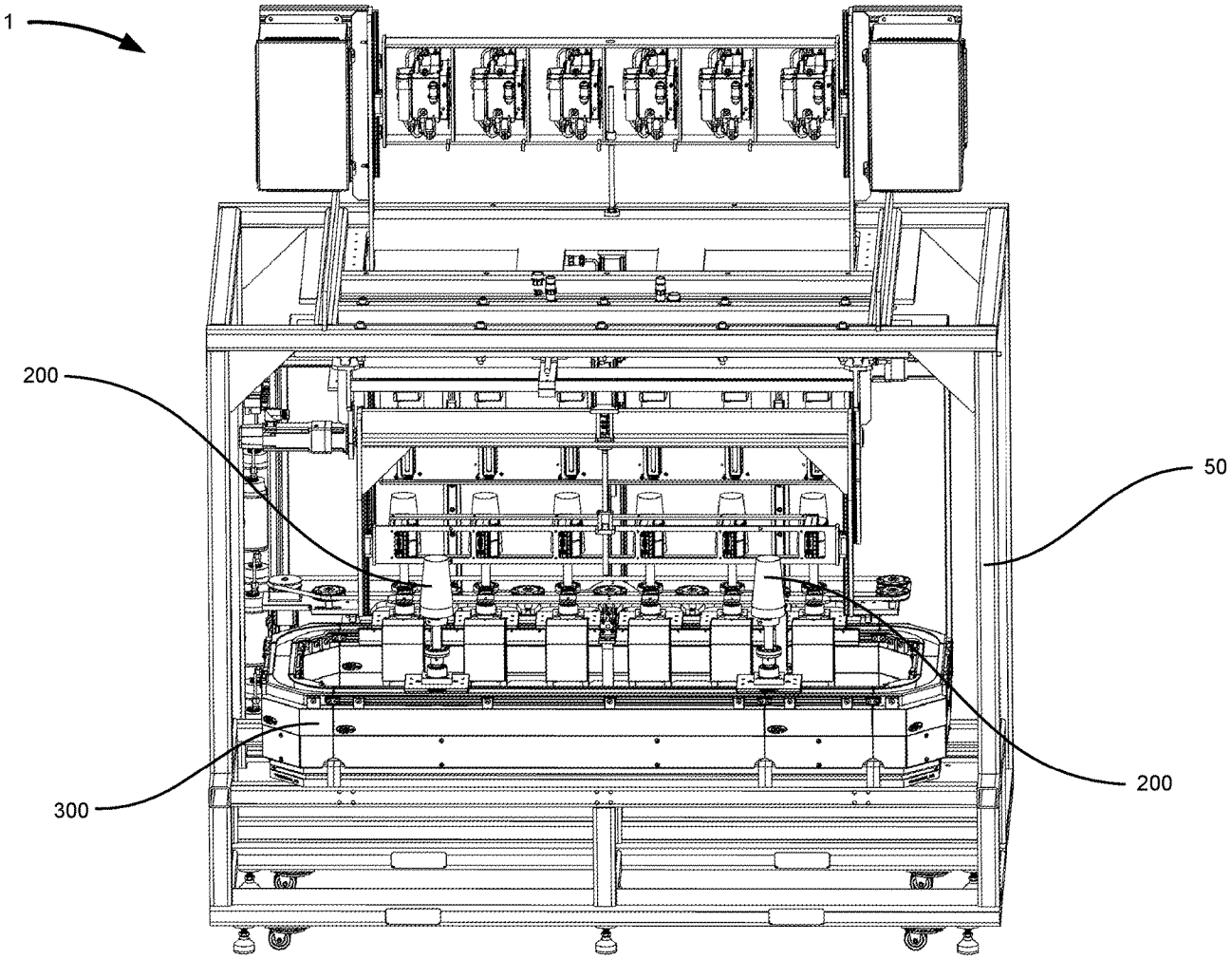
FIG. 5 is a still further perspective view of the printing system of FIGS. 1-4.

FIGS. 4 and 5 show additional perspective views of the example system 1, where an outer frame/housing 50 for the system 1 is visible. This housing 40 may, for example, support the print stations 100 (*a*)-(*f*) (and the components thereof), the conveyance module 300, and the rotational drive 400.

In the particular example shown in FIGS. 1-5, each print station 100 (*a*)-(*f*) further includes a curing system 130. Such a curing system 130 may, in some embodiments, part-cure, or 'pin', the layer of ink deposited by the associated print head 110 before a further layer is provided by the print head 110 at the next print station 100 (*a*)-(*f*). Such part-curing may, for example, be sufficient to fix the ink layer in place on the item being printed on. Of course, in other embodiments, each curing system may simply fully cure the layer of ink deposited by the associated print station 100 (*a*)-(*f*).

Though not shown in the drawings, one or more dedicated curing stations (without any print heads 110) may be provided separately from the print stations 100 (*a*)-(*f*), for example in a curing zone, which may be spaced apart from the print zone. In a particular example, a final curing station may be provided, which cures the ink once all layers have been printed by the various print stations 100 (*a*)-(*f*). Such a final curing station may be arranged such that fixtures 200 are conveyed to the final curing station after passing past all the print stations 100 (*a*)-(*f*). Such a final curing station may particularly (but not exclusively) be employed where the curing systems 130 of the print stations 100 (*a*)-(*f*) only part-cure the layer of ink deposited at the print station 100 (*a*)-(*f*) in question. In such cases, the final curing station may act to fully cures some or all of the layers of ink deposited by the various print stations 100 (*a*)-(*f*).

Each fixture 200 may support an item (not illustrated) for receiving printed information. In the illustrated example, each fixture 200 includes a frusto-conical item support member 210 for supporting an item that will receive a printed image. As discussed below, in other examples, alternatively shaped item support members 210 can be used. The item support member 210 may be configured to hold the item in place (in particular, in a desired circumferential position) during printing. In some embodiments, it may suffice to provide a friction fit between the inner surfaces of the item and the outer surface of the item support members 210; for instance, plastic light weight cups may be sufficiently held in place during printing by a support member having, for example, an aluminum surface or body. In other embodiments, the item support member 210 (or some other part of the fixture 200) might include a clamp or brace for holding the item in place. An item may be manually fitted to the item support member 210, or it may alternatively be fitted by a robotic system.

In addition to the print stations 100 (*a*)-(*f*), the printing system 1 may optionally include an inspection station, for example comprising an imaging system (such as a camera) configured to capture an image of an item coupled to the fixture 200 present at the inspection station. In particular, the inspection station may be a pre-inspection station, located so as to inspect items at the start of the printing operation, before the item is sent to the print stations 100 (*a*)-(*f*). In some embodiments, the image captured by the imaging system of an inspection station may be compared with a set of images (pre)stored in an image database, or a set of characteristics stored in a database such as a look-up table. If the result of comparison is different than (above or below) a threshold, the printing system 1 can give an alert to the user by means of a display or a sound. This may, for instance, be used to alert the user to an erroneous item-feeding operation. Such alerts may particularly (but not exclusively) be implemented in printing systems where items are fitted on the fixtures 200 robotically or mechanically.

During operation, a fixture 200 can be positioned at a print station 100 (*a*)-(*f*) adjacent the print head 110 of that print station (and adjacent any curing system 130 for the print station 100 (*a*)-(*f*)). When at a print station 100 (*a*)-(*f*), the fixture 200 may, for example, be oriented vertically, as shown in FIGS. 1-5, or in any other suitable angled position.

In embodiments, such as that shown in FIGS. 1-5, where a print station 100 (*a*)-(*f*) includes a print head 110 and a curing system 130, the print head 110 and curing system 130 may be arranged such that a fixture 200 is positioned between the print head 110 and curing system 130 of the print station 100 (*a*)-(*f*), as is shown in FIG. 3. For example, the print head 110 and the curing system 130 of a given print station 100 (*a*)-(*f*) may face one another. However, this is not essential and the print head 110 and curing station of a print station 100 (*a*)-(*f*) could instead be arranged side-by-side or in some other suitable configuration.

Once a fixture 200 has been conveyed to a particular print station 100 (*a*)-(*f*), the rotational drive 400 rotates the fixture 200 such that the surface of the item support member 210 and an item disposed thereon is rotated past the print head 110 for printing onto the item. In some embodiments, the rotational drive 400 may be operated a speed controlled for a given image, for example so as to allow the image to be printed at a desired spatial resolution on the item.

In a system such as that shown in FIGS. 1-5, where the print station 100 (*a*)-(*f*) includes a curing system 130, the item is also rotated past the curing system 130 for curing (either part-curing or full-curing, as discussed above). As is apparent from FIG. 1-5, in the particular example embodiment shown, each fixture 200 is rotated about a substantially vertical axis.

In the illustrated example, a rotational speed and rotational position of each fixture 200 located in a print station 100 (*a*)-(*f*) is independently monitored by a corresponding respective independent read head 120 for each print station 100 (*a*)-(*f*). The read head 120 for each print station 100 (*a*)-(*f*) reads the encoder ring 230 of the fixture 200 present at that print station 100 (*a*)-(*f*) to determine a circumferential position and rotational speed of that fixture 200. In some embodiments, the encoder ring 230 has a high resolution, for example providing more than 50,000 counts per revolution, more than 100,000 counts per revolution (e.g., 180,000 counts per revolution), or more than 200,000 counts per revolution. Optionally, the encoder ring 230 may be configured to provide an individual code by which the associated fixture 200 may be identified/distinguished from all others; however, this is by no means essential and hence (or otherwise), in some embodiments, the read head 120 may not be capable of distinguishing one fixture 200 from another.

The read head 120 is in communication with a corresponding print head 110 (or a controller therefor) for the print station 100 (*a*)-(*f*) in question, for communicating a position and speed signal. A print head 110 (or its corresponding controller) may use the read head 120 signals for determining a timing and speed/frequency for printing information on an item supported by the fixture 200. This may, for example, allow a swath of print to be printed in a desired circumferential position.

In one example, the print head 110 for a print station 100 (*a*)-(*f*) may be operated (e.g., by a controller therefor) at a print frequency that is directly related to the speed of rotation of the fixture 200, as indicated by the read head 120. Thus, if the read head 120 indicates that the fixture 200 is rotating at a relatively high speed, the print head 110 may be operated (e.g., by a controller therefor) at a relatively high print frequency, whereas if the read head 120 indicates that the fixture 200 is rotating at a relatively low speed, the print head 110 may be operated (e.g., by a controller therefor) at a relatively low print frequency. The encoder 230 signal from a given fixture 200 may, in some embodiments, be described as being used to dynamically adjust the print frequency of the print head 110 for a given image.

As noted above, in some examples the print heads 110 may be independently controlled by respective print head 110 controllers (not illustrated), each of which controls a printing operation of the associated print head 110 based on signals received from the corresponding independent read head 120.

In other examples, print heads 110 for multiple print stations 100 (*a*)-(*f*) (or print heads 110 for all of the print stations 100 (*a*)-(*f*)) could be independently controlled by the same controller. Such a print head 110 controller might thus control printing operations of the associated group of print heads 110 based on signals received from independent read heads 120 for multiple print stations 100 (*a*)-(*f*).

The encoder ring 230 of each fixture 200 may include a circumferential trigger or datum that enables a given read head 120 to determine a rotational position of the fixture 200, for instance an absolute rotational/circumferential position of the fixture 200. In one example, a z-pulse encoder 230 may be used as the circumferential trigger or datum, and the printing may be initiated on the detection of the z-pulse. The z-pulse may be detected once per revolution and may be used to define the reference datum.

While a single circumferential trigger or datum may be sufficient in some implementations, it will be understood that multiple circumferential triggers or datums could be provided on the fixture 200, for example in an angularly-spaced array.

Moreover, it should be understood that it is not essential that the circumferential trigger or datum for a fixture 200 is comprised by the encoder ring 230. Thus, a circumferential trigger or datum could be provided by a component of the fixture 200 separate from the encoder ring 230.

Regardless of the particular type of circumferential datum used, it should be appreciated that, by providing the circumferential datum as part of the fixture 200, the datum travels with the item through the various printing stations, therefore providing an enduring indication of the absolute rotational/circumferential position of the fixture 200 (and therefore the item). This may, for example, provide good alignment of the layers of ink printed by the various print stations 100 (*a*)-(*f*).

The print head 110 controller may use the circumferential datum or trigger to control the print head 110. For example, the print head 110, or controller of the print head 110, for a given print station 100 (*a*)-(*f*) may use the circumferential trigger of a fixture 200 present at that print station 100 (*a*)-(*f*) to ensure the printing of the print head 110 is precisely circumferentially positioned/aligned on the surface of an item (e.g., with respect to the circumferential datum). For example, if each station in a print zone includes one of cyan (C), magenta (M), yellow (Y), and black (K) inks for printing an image that includes a mixture of two or more of CMYK, each station may use the circumferential trigger information to ensure each of the C, M, Y, and K images are precisely aligned on the surface of the item. In other examples, any of a variety of sensors may be used for independently monitoring a circumferential position of each fixture 200.

As will be appreciated from the description above, the illustrated system may provide for intermittent fixture 200 circumferential position and speed monitoring as a fixture 200 is transported through a plurality of print stations 100 (*a*)-(*f*), for example because the encoder 230 of each fixture 200 is typically read only when that fixture 200 is present at one of the print stations 100 (*a*)-(*f*). This is in contrast to prior art systems, which require constant tracking of the circumferential speed through a single drive and a single encoder 230 for a full transport of a fixture 200 through all printing stations. Such intermittent and independent monitoring makes each print station 100 (*a*)-(*f*) modulated and allows for a variety of print head 110 and fixture 200 combinations. For example, the printer stations can operate independent of each other such that a color or station can be added without impacting the rest of the machine, making the system easily scalable.

Figure 6:
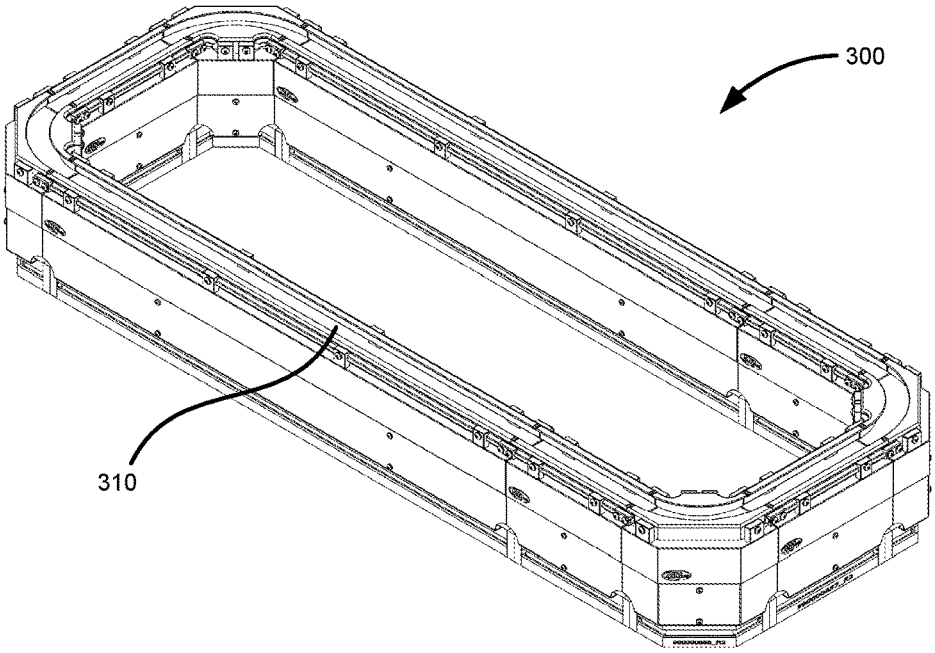
FIG. 6 is a perspective view of the conveyance module of the system of FIGS. 1-5.

FIG. 6 illustrates a conveyance module 300 of the system of FIGS. 1-5 that transports the fixtures 200 to each of the print stations 100 (*a*)-(*f*). As shown in FIG. 6, the conveyance module 300 may include a track 310 having a defined path along which the fixtures 200 are conveyed. The path may be confined to a specific plane. This plane may, for example, be perpendicular to the rotational axes of some or all of the fixtures 200. In the illustrated system, the path for the track 310 is confined to a generally horizontal plane, whereas the fixtures 200 rotate about substantially vertical axes. As will be appreciated, the track 310 may be arranged such that the path passes adjacent to each of the print stations 100 (*a*)-(*f*). In some examples, the conveyance module 300 may allow each fixture 200 to be moved independently along the path defined by the track 310.

In the illustrated example, the conveyance module 300 is a linear motor system. In one example, a MagneMotion® linear motor system from Rockwell Automation, Inc. may be used. In other examples, any of a variety of other conveyance systems may be used. In the illustrated example, the conveyance module 300 provides translational motion (e.g., motion along a path defined by a track 310, for example linear motion) by moving the fixtures 200 through the print zone, but does not provide rotational motion, the rotational motion instead being provided by the rotational drive 400. Thus, in the illustrated example, translational and rotational drives are substantially decoupled (e.g., provided by separate drive systems), which can provide a variety of benefits including non-traditional floor plan layouts outside of circular (rotary) and oval or over under layouts, ability to add on to an existing manufacturing line, and providing secondary operations such as assembly, inspection, or packaging. In some examples, the rotational drive 400 may be described as rotating each fixture 200 about a respective axis, with that axis remaining stationary with respect to the track 310 during such rotation.

Figure 7:
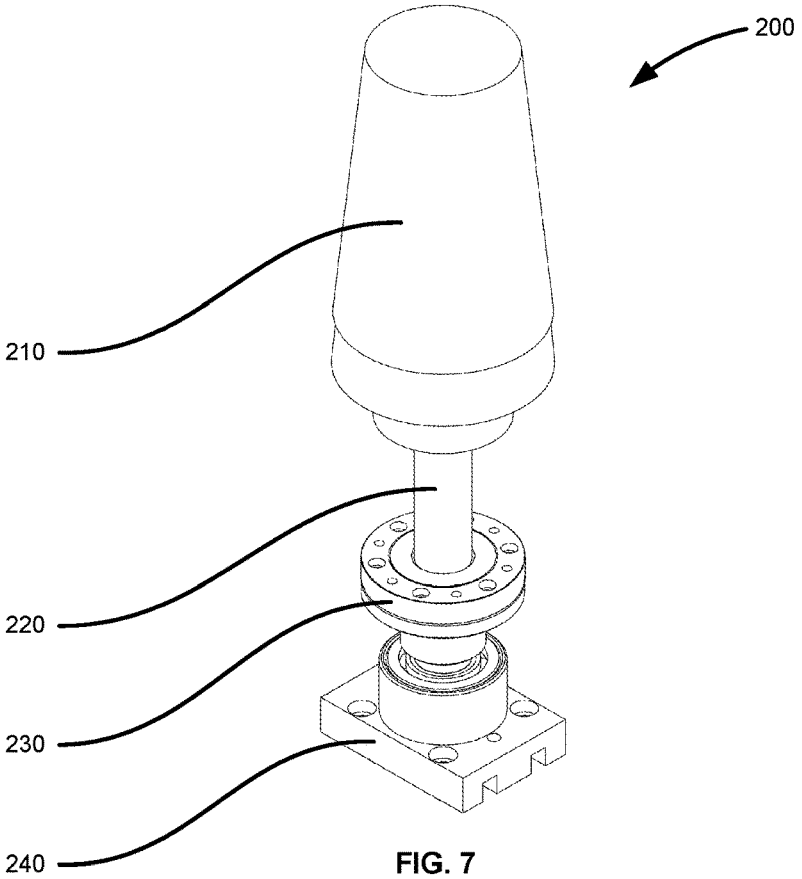
FIG. 7 is a perspective view of a fixture configured for use in the system of FIGS. 1-5.

Each fixture 200 may include a carrier portion 240 that engages with the conveyance module 300, enabling the fixture 200 to be conveyed to the printing stations. As illustrated in FIG. 7, which is a perspective view of an example of a fixture configured for use in the system of FIGS. 1-5, the carrier portion 240 of each fixture 200 may, in some examples, be configured as a base for the fixture 200; however, in other examples it could be configured as a different part of the fixture 200, for instance being disposed centrally with respect to the fixture's 200 axis of rotation. Where the conveyance module 300 includes a track 310, such as that illustrated in FIG. 6, the carrier portion 240 may engage with the track 310 so as to be movable (e.g., slideable) therealong, for example so as to follow the path defined by the track 310. In addition, or instead, the carrier portion 240 may be configured such that at least the item support member 210 is rotatable with respect thereto. For instance, as illustrated in FIG. 7, the item support member 210 may be fixedly attached or joined to a shaft 220 for the fixture 200, which is rotatably coupled to the carrier portion; alternatively, the item support member 210 itself could be rotatably coupled to the carrier portion.

The conveyance module 300 may be configured such that it can hold or lock a given fixture 200 in place at a printing station (or at another location), for instance by interacting with a carrier portion of that fixture 200. In one example, a location of the fixtures 200 on the conveyance module 300 can be determined with pneumatically engaged conical pin registration to precisely locate the fixtures 200 at each printing station. In other examples, a position indicator associated with the linear motor system may be used to control a position of each fixture 200 in each printing station.

As noted above, FIG. 7 illustrates but one example of a fixture 200 for supporting an item for receiving printed information, such as product packaging. As will be appreciated by a person having ordinary skill in the art, although the illustrated item support member 210 is frusto-conical, any of a variety of other shapes and configurations may be used, which can be dictated by the specific size and shape of the item requiring printed information. The fixture 200 may be made up of a light weight material. Furthermore, the fixture 200 may be made up of a material which can absorb or block UV light, particularly (but not exclusively) where the fixture 200 is disposed between the print head 110 and the curing system 130, so as to reduce the risk that UV light has an adverse effect on the print head 110 (e.g., by curing ink at the nozzles of the print head 110).

The item support member 210 and the encoder ring 230 for each fixture 200 are typically arranged on the fixture 200 so that they co-rotate at the same angular velocity. In the example fixture 200 illustrated in FIG. 7, the encoder ring 230 is provided on a shaft 220 of the fixture 200, with the item support member 210 being fixedly attached or joined to the shaft 220. The shaft 220 may in turn be rotationally coupled to a carrier portion of the fixture 200 (which, as described above, may be a base for the fixture 200).

Figure 8:
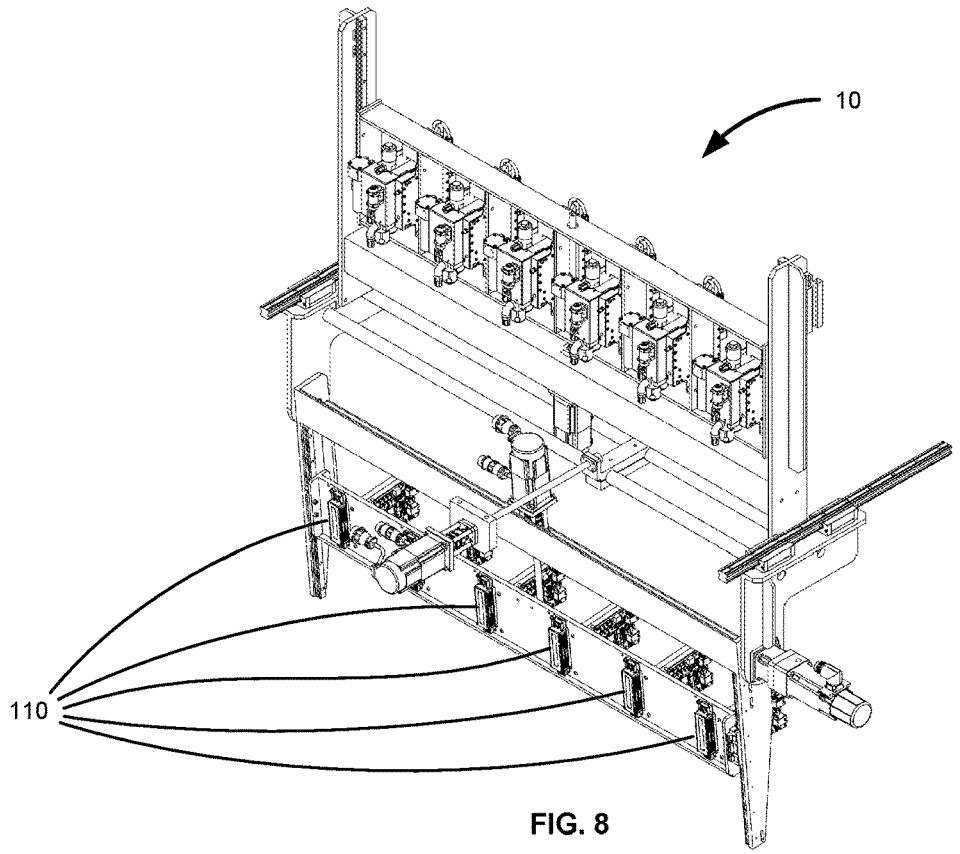
FIG. 8 is a perspective view of the print head module of the system of FIGS. 1-5.

FIG. 8 illustrates the print head module 10. The print head module 10 may contain all subsystems to support full printing. In the illustrated example, the print module includes the print heads 110 of every print station 100 (*a*)-(*f*) in the printing system 1; however, in other examples, several print modules could be provided, with each such print module including the print heads 110 of a corresponding group of print stations 100 (*a*)-(*f*).

As is apparent from FIG. 8, in the particular example shown, the print head module 10 includes six print heads 110, corresponding to six print stations 100 (*a*)-(*f*). The print head module 10 may thus be configured for six colors, with each color being printed by the print head 110 at a corresponding one of the print stations 100 (*a*)-(*f*). In the module, a print head 110 can be moved individually or a plurality of print heads 110 may be mounted on a printbar and can be moved as a group. An alignment of print head 110 with respect to the fixture 200 can be based on the shape and/or height of the fixture 200.

Figure 11:
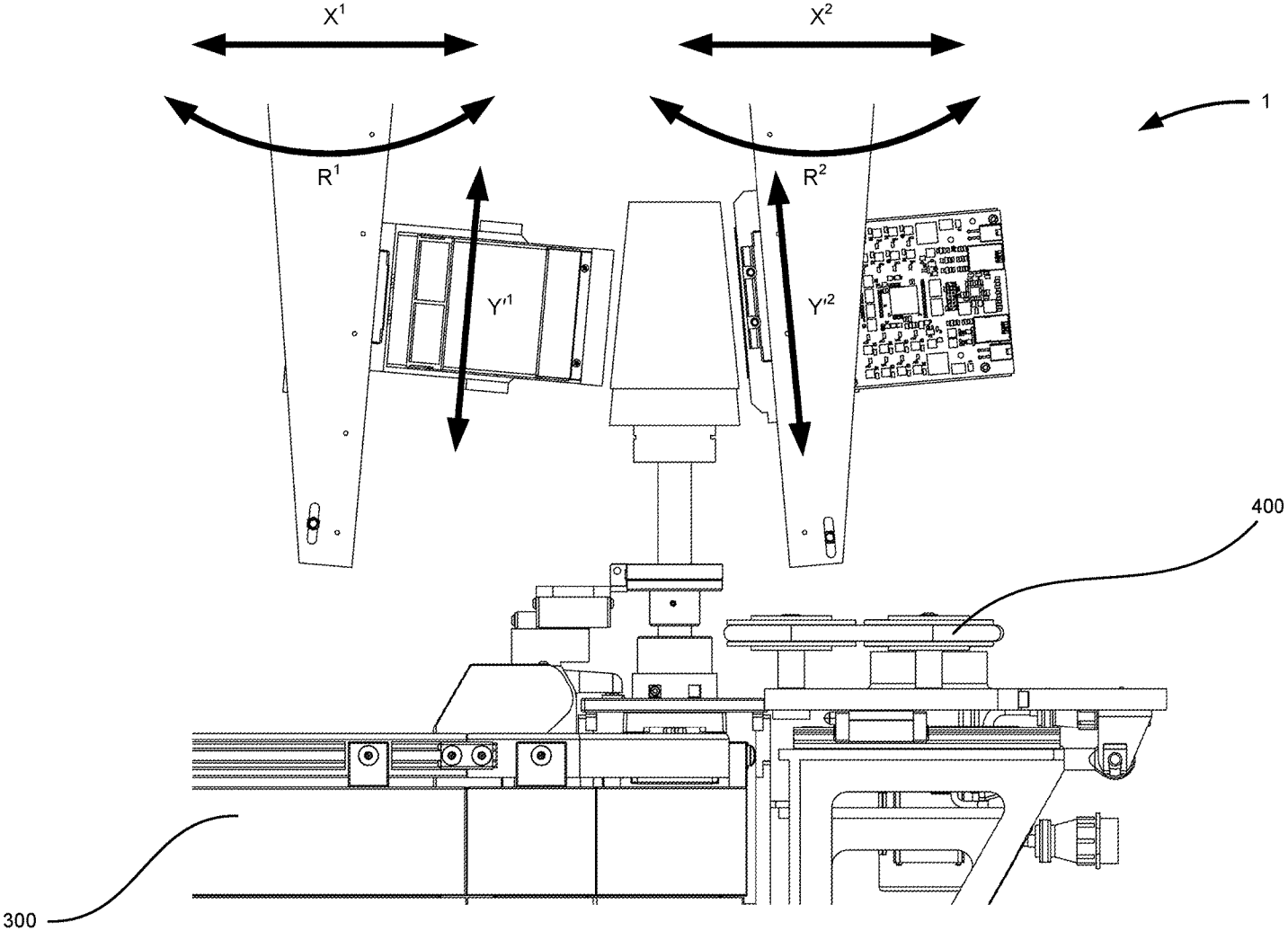
FIG. 11 is an annotated version of FIG. 3, showing the directions in which the curing and printing modules can move.

Referring to FIG. 11, which is an annotated version of FIG. 3, as illustrated, the print head module 10 may be configured such that it can move the associated print heads 110 according to the following axes: rotation $R^2$ (rotation about an axis perpendicular to the axis of rotation of a fixture 200 and/or parallel to the direction in which a fixture 200 is conveyed to/from a print station 100 (*a*)-(*f*)); vertical travel $Y'^2$ (movement in a direction parallel to the nozzle array(s) of a print head 110 and/or at the chosen angle about axis $R^2$); and infeed $X^2$ (movement in a direction perpendicular to the direction in which a fixture 200 is conveyed to/from a print station 100 (*a*)-(*f*) and to the axis of rotation of that fixture 200). The print head module 10 may accordingly include one or more motors, such as servo motors. These degrees of freedom enable a print head 110 to be aligned substantially parallel to the surface of the item during initial set-up. During printing, it allows the print head 110 to track 310 the surface of variously-shaped items, such as cylindrical, conical, frusto-conical, or other generally rotationally symmetric items. Hence, or otherwise, they may give the customer the ability to print over the full extent of the item in the axial direction and thus, for example, the ability to do either stitch or helix printing on such items. In the illustrated example, each print head 110 includes an independent controller for independently controlling printing at the corresponding print head 110 based on the position and speed information provided by the independent read heads 120.

Figure 9:
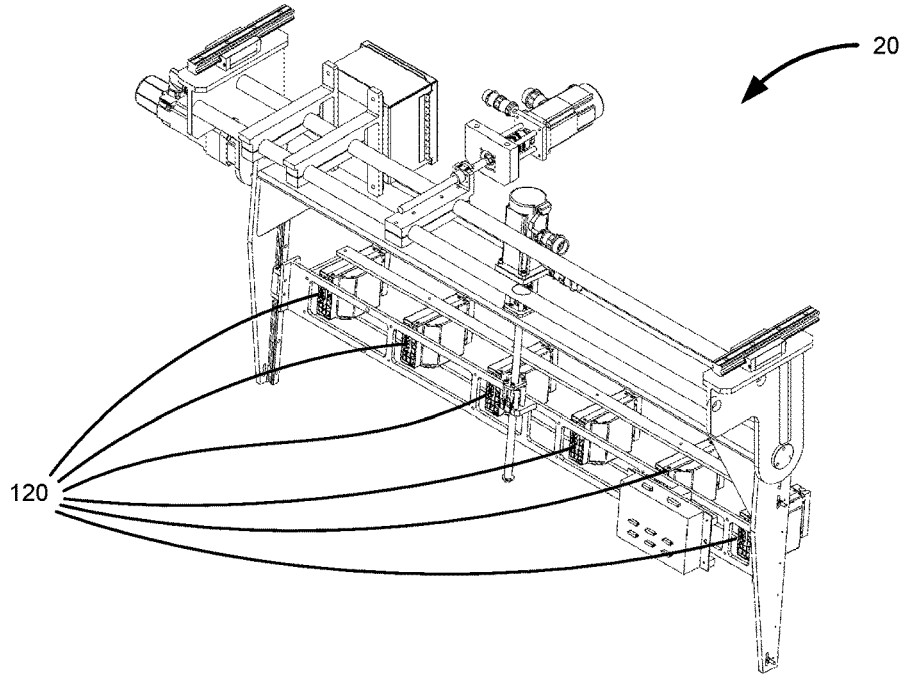
FIG. 9 is a perspective view of the curing module of the system of FIGS. 1-5.

FIG. 9 illustrates the curing module 30. In the illustrated example, the curing module 30 includes the curing system 130 of every print station 100 (*a*)-(*f*). In some embodiments, the curing module 30 may be an ultraviolet (UV) curing module 30, which uses UV light to cure UV-curable ink (either part-curing or fully-curing the ink, as discussed above). In other examples, any other kind of curing technique may be used, such as hot air. Referring to FIG. 11, the curing module 30 can move according to the following servo axis: rotation $R^1$ (rotation about an axis perpendicular to the axis of rotation of a fixture 200 and/or parallel to the direction in which a fixture 200 is conveyed to/from a print station 100 (*a*)-(*f*)); vertical travel $Y'^1$ (movement at the chosen angle about axis $R^1$); and infeed $X^1$ (movement in a direction perpendicular to the direction in which a fixture 200 is conveyed to/from a print station 100 (*a*)-(*f*) and to the axis of rotation of that fixture 200). These degrees of freedom may enable a curing system 130 to track 310 the surface of variously-shaped items, such as cylindrical, conical, frusto-conical, or other generally rotationally symmetric items.

The curing module 30 may be movable independently of the printing module, for example so as to reduce the risk of the curing module 30 curing ink present on the print heads 110 of the printing module, which may cause the print heads 110 to malfunction. In addition, or instead, where the curing module 30 and the print head module 10 are disposed on opposite sides of the fixtures 200, these degrees of freedom may enable the curing module 30 to move down the side of a conical item at the same rate, but opposite angle, as the print head module 10.

As discussed further above, the printing system 1 may additionally include a final curing station, which is typically separate from the curing module 30. Once the printing (and curing) is completed, the fixture 200 is moved to this final curing station, which may, for example, comprise a high intensity curing system for completing the curing of the fully printed item coupled to the fixture 200.

Figure 10:
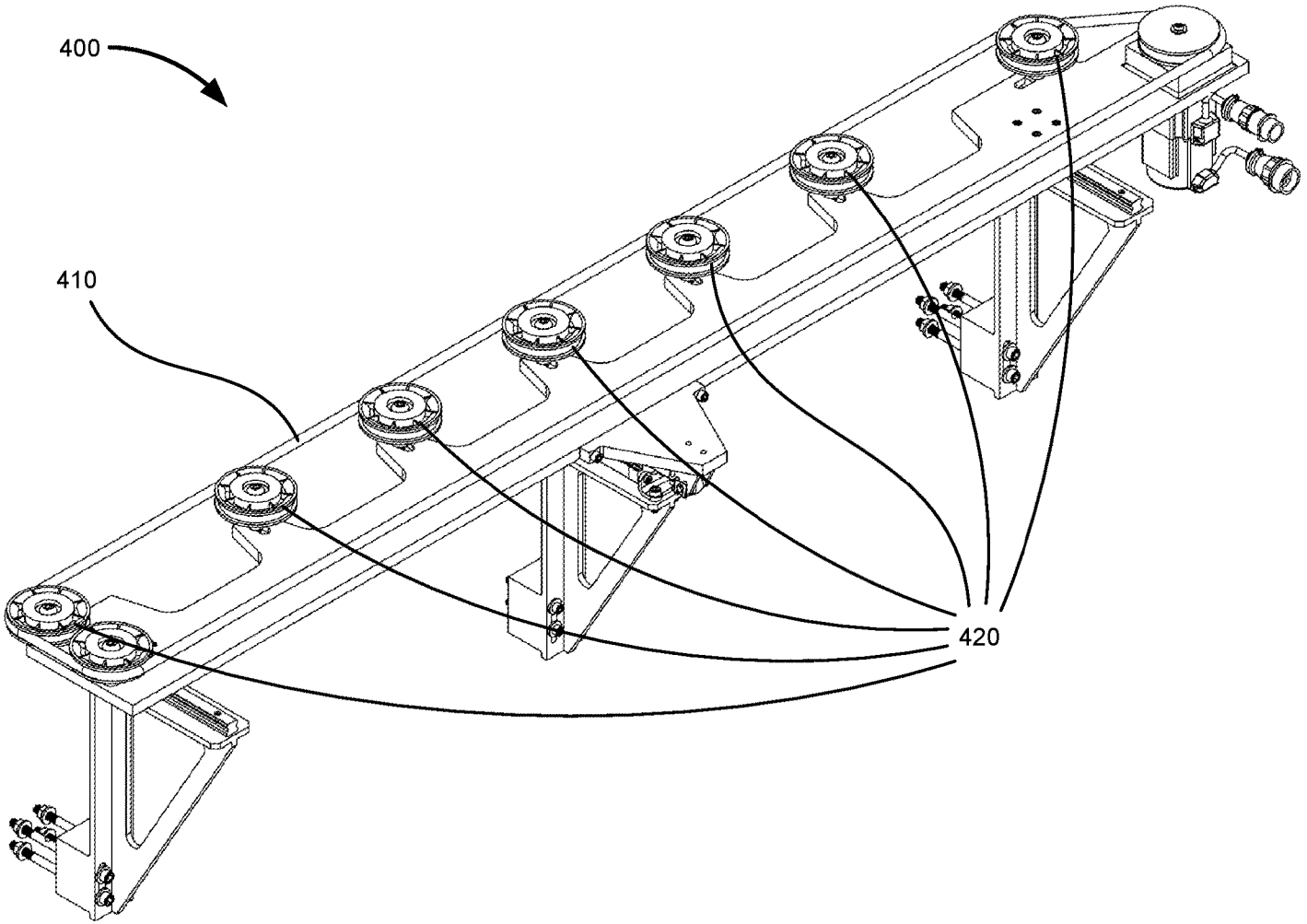
FIG. 10 is a perspective view of the rotational drive of the system of FIGS. 1-5.

FIG. 10 shows the rotational drive 400 for rotating each of the fixtures 200. The illustrated example is a belt drive, and may use any kind of belt 410, e.g., round or flat. A belt drive may be straightforward to re-configure in case a further station is added to the system and/or in case an existing station is moved within the system. The rotational drive 400 is configured to rotate the associated fixtures 200, for instance over a large speed range; it may therefore, for example, include a servo controlled drive motor. Furthermore, where the conveyance module 300 includes a track 310 having a defined path, the belt 410 may be configured such that it follows a path that runs alongside the path of the track 310, for example for at least the portion of the track 310 corresponding to the print stations 100 (*a*)-(*f*) associated with the belt drive.

In some embodiments, the belt 410 contacts a radially-outfacing surface of the fixture 200. In the particular example shown, the shaft 220 of the fixture 200 provides this radially-outfacing surface; however, depending on the particular fixture 200 construction, other radially-outfacing surfaces may be suitable. Such an arrangement may provide greater tolerance for errors in the positioning of fixtures 200 at a given print station 100 (*a*)-(*f*), may provide greater tolerance for errors in the positioning of the belt 410 with respect to the print stations 100 (*a*)-(*f*), and/or may enable print stations 100 (*a*)-(*f*) to be set up at a greater range of locations.

It should however be understood that it is by no means essential that the rotational drive 400 is a belt drive 410.

Rather, any of a variety of rotational drive 400 systems may be used, such as independent friction wheels for driving each fixture 200. Indeed, in some examples, the rotational drive 400 may not engage mechanically with the fixtures 200; for instance, the rotational drive 400 might magnetically couple with the fixtures 200. In one such example, the rotational drive 400 might include a respective magnetic coupling part for each printing station, with all such magnetic coupling parts (and thus the rotational drive 400 as a whole) being rotationally driven by a single motor, for example by mechanically linking the magnetic coupling parts (e.g., using drive belts, gears or the like).

Although in the example described above the rotational drive 400 includes a servo controlled drive motor, it should be understood that any suitable drive motor may be utilized. It should further be appreciated that, in some examples, the rotational drive 400 may include only a single drive motor.

The rotational drive 400 can be configured to be releasably coupled to the associated fixtures 200 (e.g., to the shafts 220 thereof), such that the rotational drive 400 disengages/decouples from the fixtures 200 in advance of translational movement of the fixtures by the conveyance module 300 and such that the rotational drive 400 then engages/couples with the fixtures 200 for rotational movement after they have been moved to printing stations 100 (*a*)-(*f*) by the conveyance module 300.

In some examples, the rotational drive 400 may include a friction drive belt 410 system with no positive mechanical engagement on the fixture 200. In such examples, a pneumatically actuated linear slide may be included on the belt 410 system for increasing the frictional coupling between the belt 410 and the fixtures 200, thus releasably coupling the drive to those fixtures 200. In examples where the rotational drive 400 magnetically couples with the fixtures 200, a corresponding actuable mechanism may be provided; for instance, where a respective magnetic coupling part is provided for each printing station, these could be individually movable by respective linear motors so that each of them can be selectively magnetically, and therefore rotationally, coupled with a fixture present at the associated print station.

In some embodiments, the rotational drive 400 may be configured such that it can be selectively coupled with any of the fixtures 200 present at a chosen one or more of said print stations 100 (*a*)-(*f*) (e.g., by providing a number of individually controllable pneumatically actuated linear slides 420 in the system shown in FIG. 10). However, in a more straightforward implementation, the rotational drive 400 could be configured such that it can either be rotationally coupled to, or rotationally decoupled from, fixtures 200 present at any of said print stations 100 (*a*)-(*f*).

In still other examples the system may include separate rotational drives 400 for driving one or more fixtures 200 located in print stations 100 (*a*)-(*f*). For instance, one rotational drive (e.g., a first belt drive) could rotate fixtures in a first group of print stations and another rotational drive (e.g., a second belt drive) could rotate fixtures in a second group of print stations; such an arrangement might be particularly appropriate in examples where the first group of print stations are spaced apart from the second group of print stations, for example because of space constraints resulting from the components of the print stations, or the particular floor plan layout, or because it is desired to include a non-printing station (for example a final curing station or other treatment after the first group of print stations and before.

Figure 12:
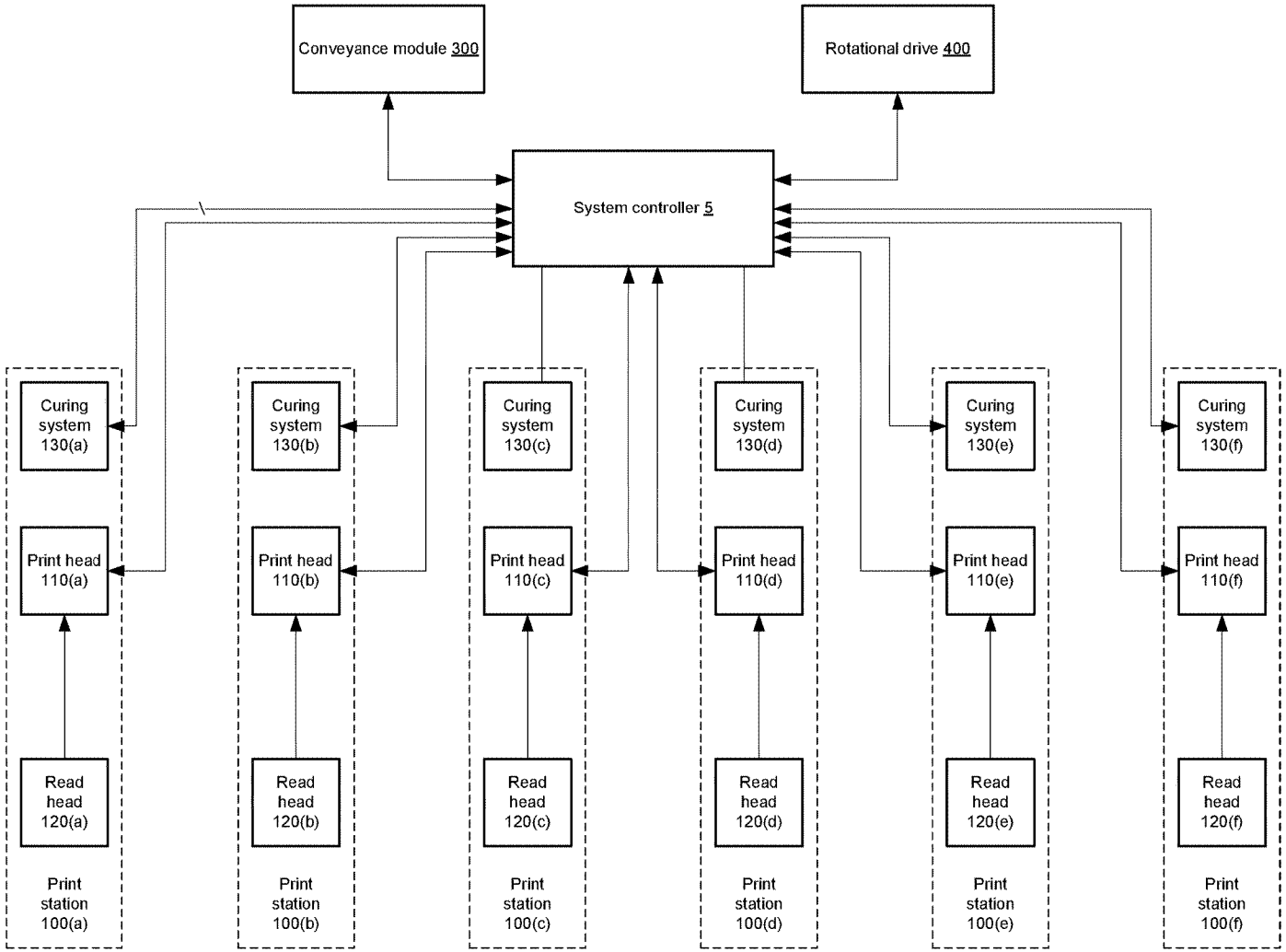
FIG. 12 is a schematic diagram of an example embodiment of a rotary digital printing system, illustrating the interaction of the various subsystems.

Referring now to FIG. 12, as shown, the printing system 1 may further include a system controller 5, which controls and co-ordinates the operation of the printing stations 100 (*a*)-(*f*) (or the components thereof, including the print heads 110 and any curing systems 130 at the printing stations), the rotational drive 400, and the conveyance module 300. The system controller 5 may be responsible for overall control of the system, and may thus receive status/operating data from the printing stations (or the components thereof), the rotational drive 400, and/or the conveyance module 300. Such data may assist the system controller in coordinating the operation of each of these sub-systems. For instance, the system controller 5 might wait until the conveyance module 300 indicates that the intended fixtures 200 have been conveyed to respective, desired print stations 100 (*a*)-(*f*), and have been held in place there, before signaling the rotational drive 400 to begin rotating those fixtures 200 at their respective print stations 100 (*a*)-(*f*). For example, where the rotational drive 400 is configured so as to be releasably coupled to the fixtures 200, the system controller may signal the rotational drive 400 to couple with the associated fixtures 200. Once the rotation and printing is completed, it may then signal the rotational drive 400 to decouple from the associated fixtures 200, for instance so as to allow the conveyance module 300 to move the fixtures 200 further through the print zone.

As discussed further above, and as shown in FIG. 12, in some embodiments the print head 110 of each print station 100 (*a*)-(*f*) may be provided with a respective print head 110 controller, which communicates with the read head 120 for that print station 100 (*a*)-(*f*), so that, for example, each print swathe generated by a given print head 110 is printed in a desired circumferential position on an item, and/or so that the print swathes printed by the various print stations 100 (*a*)-(*f*) onto a given item are aligned on that item. Nonetheless, the system controller 5 might co-ordinate operation of the rotational drive 400 with the operation of the printing stations 100 (*a*)-(*f*) in addition to such coordinated operation.

In some embodiments, the system controller may communicate with the print heads 110 (or with controllers therefor) so as to provide image data to be printed. For example, the system controller might generate respective sets of image data, each of a single color, to be printed by the print head 110 of a corresponding print station 100 (*a*)-(*f*). Thus, the system controller might split a CMYK image into separate cyan, magenta, yellow and black images to be printed by respective print stations 100 (*a*)-(*f*). The system controller might additionally be configured to carry out color conversion (e.g., from RGB to CMYK) and/or resolution conversion of a received image.

In other embodiments, such image data processing might be provided by a dedicated print server, which communicates with each of the print heads 110 (or controllers therefor).

While in the embodiments described above with reference to FIGS. 1-12, each print station includes only one printhead and one curing station, it should be understood that this is by no means essential. Accordingly, in other examples, each print station might include several printheads and/or several curing systems.

Some benefits provided by systems made in accordance with the present disclosure include the ability to load and unload fixtures, whether manually or with robotics; the ability to pretreat with a flame unit or corona treatment; and the ability to provide an inspection station, where a fixture can be removed from the conveyance module without stopping operation of the system. Additional benefits also include providing a printing system for a high mixture of product types and medium volume production; providing redundancy in the system, for example, if one fixture, transport, print stations, or encoder is disabled for maintenance, the system can still be operational; allowance for external operations to be conducted in process, for example, inspection, pretreatment, post packaging, etc. without disrupting the flow of work; and the system can be scaled up or down with minimal design changes to run one or more fixtures as desired and based upon production needs.

Exemplary embodiments have been disclosed above and illustrated in the accompanying drawings. It will be understood by those skilled in the art that various changes, omissions and additions may be made to that which is specifically disclosed herein without departing from the spirit and scope of the present disclosure.

What is claimed is:

1. A rotary digital printing system, comprising:

a print zone, which comprises a plurality of independent print stations, each print station comprising a respective print head, and read head;

a plurality of fixtures, each fixture comprising an item support member and being configured to support an item that is to receive printed information, and comprising an encoder ring that can be read by the read head of a given print station to determine a circumferential position and rotational speed of the fixture in question;

a rotational belt drive for frictionally coupling with said fixtures and for rotating each fixture positioned in a print station such that the surface of the item support member and an item disposed thereon is rotated past the print head for printing; and a conveyance module for transporting the fixtures to said print stations;

wherein the system is configured so as to convey, using said conveyance module, the plurality of fixtures through the print zone, stopping at one or more of the print stations, and wherein the belt drive is configured to be releasably coupled to the fixtures, such that the rotational drive decouples from the fixtures in advance of translational movement of the fixtures by the conveyance module, and such that the rotational drive couples with the fixtures for rotational movement after they have been moved to the print stations by the conveyance module.

2. The system of claim 1, wherein said belt contacts a radially-outfacing surface of each of said fixtures in order to cause rotation thereof.

3. The system of claim 1, wherein the belt drive is configured so as to be selectively coupleable to any of said fixtures present at a chosen one or more of said print stations.

4. The system of claim 1, wherein the belt drive is configured so as to be selectively coupleable to fixtures present at any of said print stations.

5. The system of claim 1, wherein the conveyance module comprises a track having a defined path along which the fixtures are conveyed.

6. The system of claim 5, wherein the belt drive runs alongside the path of said track.

7. The system of claim 5, wherein each fixture comprises a carrier portion, configured to engage with said track so as to be movable therealong, and an item support member, configured to support an item that is to receive printed information; and wherein said item support member is rotatable with respect to said carrier portion.

8. The system of claim 1, wherein the conveyance module is a linear motor system.

9. The system of claim 1, wherein the conveyance module provides translational motion of the fixtures, moving the fixtures through the print zone, but does not provide rotational motion of the fixtures, the rotational motion of the fixtures being provided by the rotational drive.

10. The system of claim 1, wherein a location of the fixtures on the conveyance module can be determined with pneumatically engaged conical pin registration.

11. The system of claim 1, wherein a location of the fixtures on the conveyance module can be determined by a position indicator associated with the linear motor system of the conveyance module.

12. The system of claim 1, wherein the item support member is coupled to a shaft configured to be releasably coupled to the belt drive such that the fixture can be decoupled from the belt drive in advance of translational movement of the fixtures by the conveyance module and coupled to the belt drive for rotational movement after the fixtures have been moved to the printing station.

13. The system of claim 1, wherein the drive belt has no positive mechanical engagement on the fixture.

14. The system of claim 1, wherein a pneumatically actuated linear slide is provided on the drive belt for increasing the frictional coupling between the belt and the fixture.

* * * * *